US005875567A

United States Patent [19]

Bayley

[11] Patent Number: 5,875,567

[45] Date of Patent: Mar. 2, 1999

[54] SHOE WITH COMPOSITE SPRING HEEL

[76] Inventor: Richard Bayley, 747 H St., Wasco, Calif. 93280-2031

[21] Appl. No.: 844,563

[22] Filed: Apr. 21, 1997

[51] Int. Cl.[6] ..... A43B 13/28; A43B 21/32

[52] U.S. Cl. ..... 36/27; 36/37

[58] Field of Search ..... 36/27, 7.8, 37, 36/28, 107

[56] References Cited

U.S. PATENT DOCUMENTS

| | | | |
|---|---|---|---|
| 4,457,084 | 7/1984 | Horibata et al. | 36/7.8 |
| 4,492,046 | 1/1985 | Kosova | 36/27 |
| 4,566,206 | 1/1986 | Weber | 36/27 X |
| 4,592,153 | 6/1986 | Jacinto | 36/27 X |
| 5,060,401 | 10/1991 | Whatley | 36/27 X |
| 5,138,776 | 8/1992 | Levin | 36/27 X |
| 5,381,608 | 1/1995 | Claveria | 36/27 X |
| 5,396,718 | 3/1995 | Schuler et al. | 36/27 X |

*Primary Examiner*—B. Dayoan
*Attorney, Agent, or Firm*—Drummond & Duckworth

[57] ABSTRACT

A shoe with a spring between the upper and lower surfaces of the sole. The spring is a V-shaped composite assembly, including an upper plate underlying at least a the heel of the wearer's foot and lower plate integrally joined to the upper plate at the apex of the V-shaped spring assembly.

3 Claims, 3 Drawing Sheets

SHOE WITH COMPOSITE SPRING HEEL

BACKGROUND—FIELD OF INVENTION

This invention pertains to a shoe, that has a novel composite spring heel.

BACKGROUND—DESCRIPTION OF PRIOR ART

Many types of shoes have foam heels to cushion the impact with the ground. Foam heels do a good job of cushioning impacts with the ground, but do not return much impact energy to the momentum of the walker, as the shoe makes contact with the ground.

Some attempts by inventors have been made to design a shoe heel that cushions impact, and return a significant amount of the impact energy absorbed by the heel back to the momentum of the walker. Two of the proposed spring heel shoe designs were cited in U.S. Pat. No. 4,566,206 (1986), and U.S. Pat. No. 5,282,325 (1994). The two cited patents and many similar U.S. and foreign patents are all plagued with one or a combination of the following undesirable traits: (a) The added weight of the spring heel causes the shoe weight to go up significantly. This excessive added weight will cancel out the benefit from the rebounding spring force from the heel, (force equals mass times acceleration); (b) The spring heel rebound force is so low, that the spring heel mechanism is ineffective for its designed purpose; (c) The distance the compressing plate on the spring heel moves, is too short. Therefore only a small amount of work can be done by the spring heel. The distance traveled by the rebounding plate on the spring heel must be as great as possible to maximize the work done by the spring heel (work equals force times distance). (d) The spring heel inserted in the shoe, makes the shoe uncomfortable to wear. (e) The spring heel makes the shoe unattractive. (f) The spring heel does not give good arch support to the foot. (h) Spring heel is not enclosed by covering, which allows water and dirt to accumulate inside. (i) The spring heel has no provisions for adjustment of its spring rate.

OBJECTS AND ADVANTAGES

Some of the objects and advantages of the present invention are: (a) The materials used to make the spring heel are very lightweight while having high strength properties. (b) The composite spring heel is designed to give a large rebound push to the shoe. (c) The flexing plates in the composite spring heel are designed to travel the maximum distance allowable. The greater distance traveled by the plates allows more energy to be absorbed and transmitted from the shoe smoothly. (d) The composite spring heel is designed to fit inside a shoe while maintaining normal contour angles necessary or comfortable wearing of the shoe. (e) A shoe or boot containing a composite spring heel looks much like a normal walking shoe or boot. (f) The shoe's spring heel is covered with a weather and dirt resistant covering. (g) An optional helical compression spring can be installed between the plates of the composite spring heel if higher compression and rebounding forces are called for. (h) Less effort is exerted while walking in shoes with composite spring heels. (i) The composite spring heel is long enough so the arch on the bottom of a foot will have full arch support while walking. (j) The spring rate for the composite spring heel can be adjusted to meet load demands put on by user.

DRAWINGS

BRIEF DESCRIPTION OF THE INVENTION

In accordance with the broadest aspects of my invention, I provide improvements in shoes provided with spring heels. In general such shoes include a sole having a heel portion shaped and dimensioned to underlie the heel of the wearer's foot, a forefoot portion shaped and dimensioned to underlie the ball of the wearer's foot between the heel and forefoot portions, and a spring between the upper and lower surfaces of the sole. My improved spring for use is such a shoe includes two elongate, substantially rigid plates, formed integrally as a V-shaped composite spring assembly. The spring assembly comprises an upper plate, shaped and dimensioned to underlie at least the heel portion of the sole, and a lower plate beneath the upper plate, the upper and lower plates integrally joined at the apex of the V-shaped spring assembly and extending laterally beyond arch portion of sole to permit selective removal of rigid plates to provide a spring means having an adjustable spring rate.

Description of FIGS. 1 to 8

Figure 1:
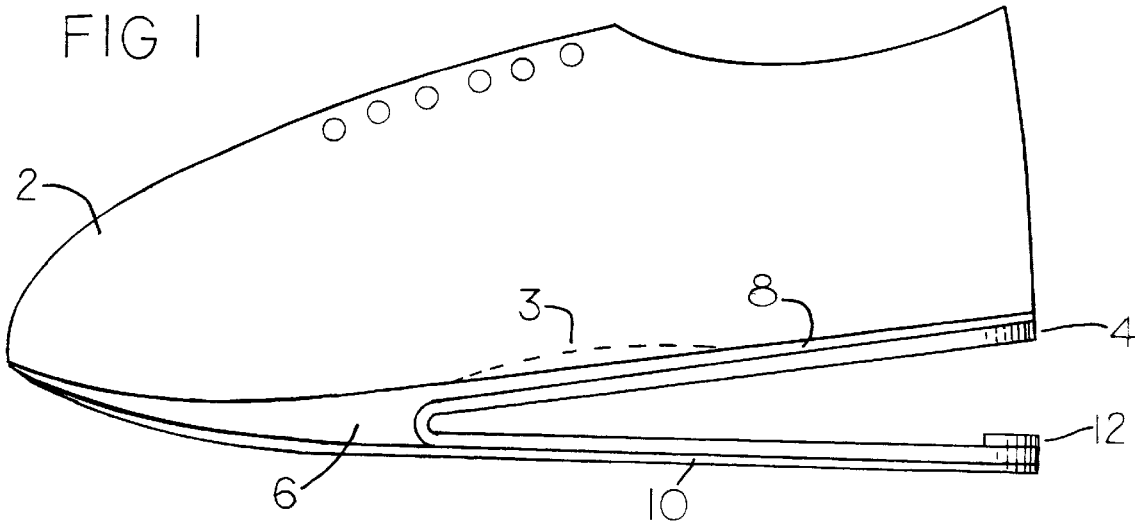
FIG. 1 shows a longitudinal side view of a typical walking shoe with composite spring heel in the uncompressed position.

FIG. 1 is a side view drawing of a typical walking shoe 2. The insoles arch 3 is outlined with hidden lines. The heel is made from a V-shaped composite spring 4. A conventional walking shoe heel is often made from foam rubber. The shoe in this invention has a heel where the majority of foam rubber in the heel has been removed, up to the forward sole area 6. The V-shaped composite spring 4 is inserted and attached between the top heel portion of the shoe 8, and the outsole 10. A foam rubber cushioning pad 12 is attached to the inside rear bottom portion of the composite spring heel.

Figure 2A:
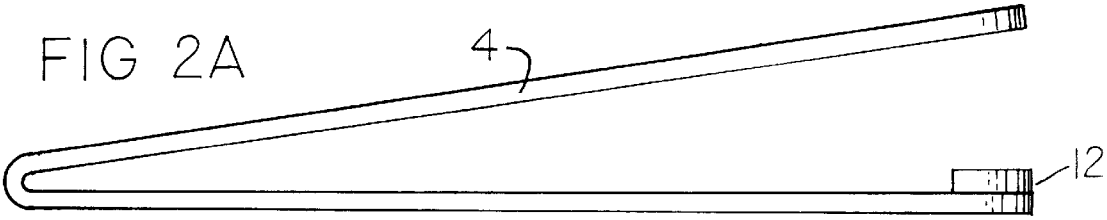
FIG. 2A shows a longitudinal side view of the composite spring heel in the uncompressed position.

FIG. 2A is a side view drawing of composite spring heel 4, in fully elevated uncompressed position.

Figure 2B:
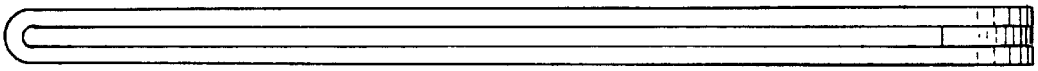
FIG. 2B shows a longitudinal side view of the composite spring heel in the fully compressed position.

FIG. 2B is a side view of the composite spring heel 4, in the fully compressed position. The spring has been compressed down to the spring's minimum height. Downward accent of top plate is stopped as top plate partially compresses foam rubber pad 12.

Figure 3:
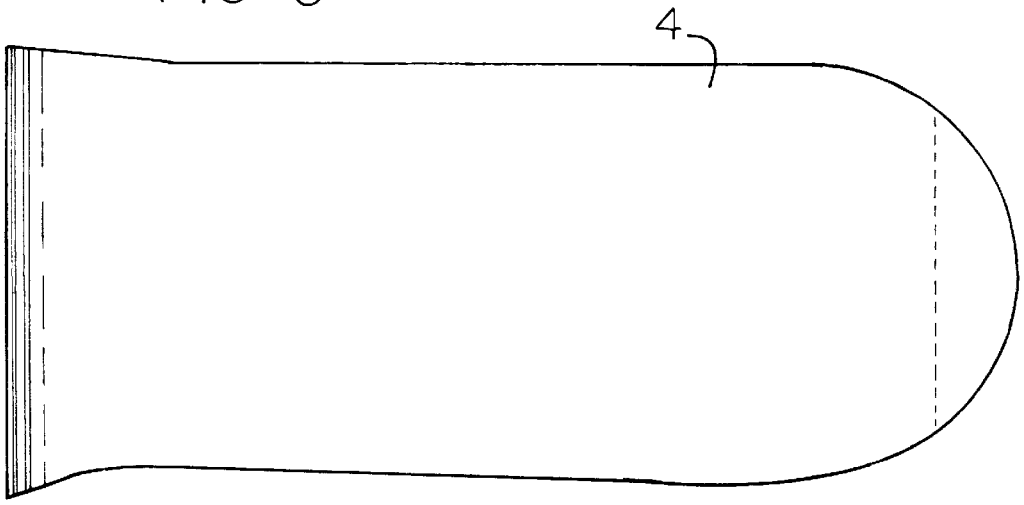
FIG. 3 shows a longitudinal overhead view of the composite spring heel.

FIG. 3 is an overhead longitudinal view of the composite spring heel 4.

Figure 4:
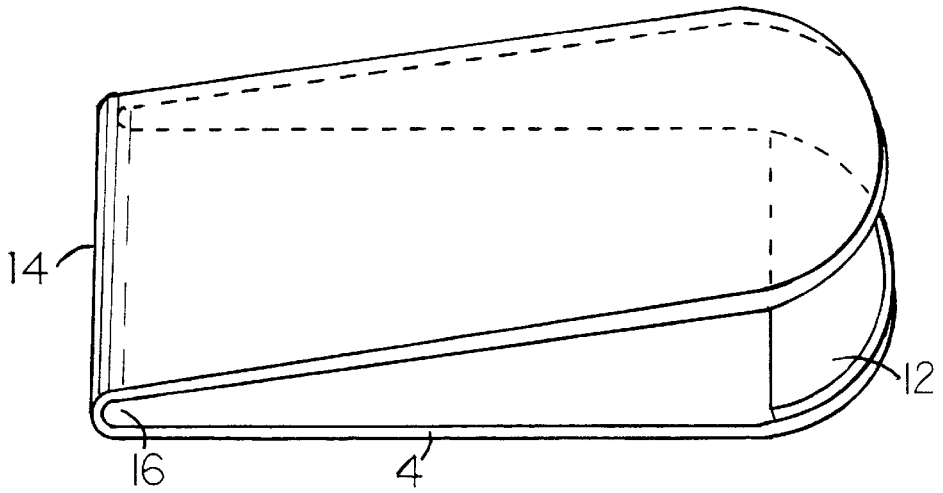
FIG. 4 is a perspective view of the composite spring heel.

FIG. 4 is a perspective view of composite spring 4, in the uncompressed position. The angle 16 between the plates is approximately ten degrees. The width along apex 14, is the same width as the midsection of upper and lower plates.

Figure 5:
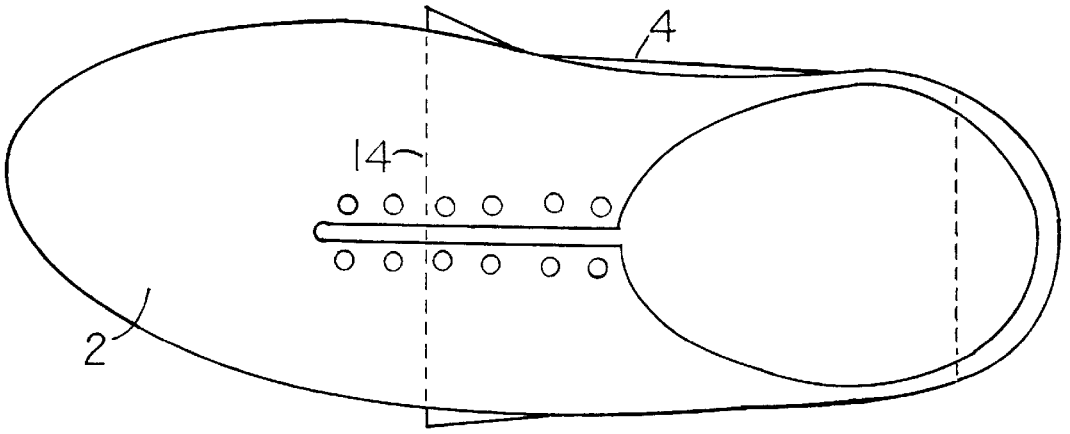
FIG. 5 shows longitudinal overhead view of shoe with composite spring heel.

FIG. 5 is a overhead view of shoe 2, with composite spring 4. The hidden lines follow the axis of the apex 14, of the composite spring 4. The width along apex 14, is 1.25 times greater than the width of midsection of upper and lower plates. The shoe of the present invention includes a V-shaped composite spring disposed substantially in the heel and arch portions of the shoe. The outer edges of the tapered compression spring extend laterally beyond the sides of the sole of the shoe to produce a shoe having an adjustable spring rate. More particularly, the portion of the tapered compression spring extending beyond the sides of the shoe may be ground down, cut, milled, etc. to reduce the overall spring rate of the composite spring heel. In this manner, a shoe of a specific size can be manufactured to accommodate the needs of different users requiring shoes with different spring rates.

Figure 6:
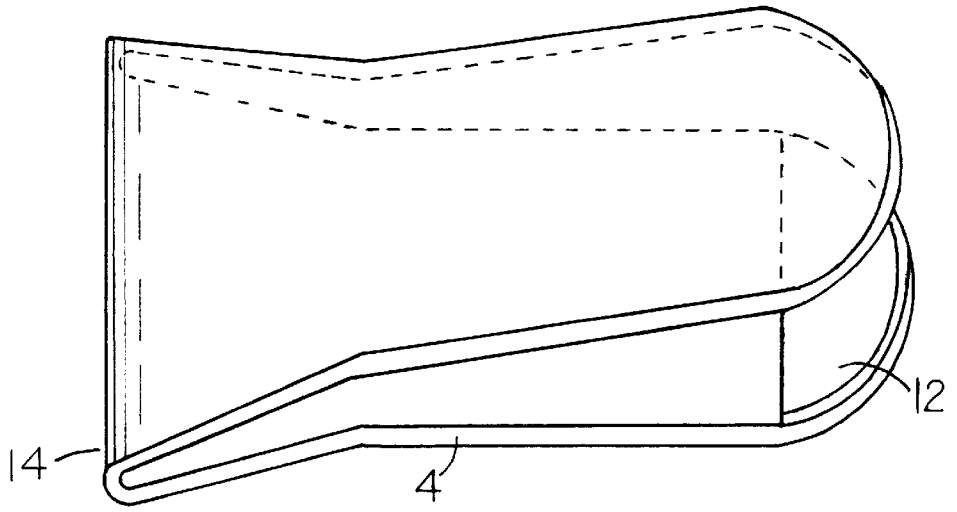
FIG. 6 is a perspective view of the composite spring heel.

FIG. 6 as a perspective view of the composite spring 4, in the uncompressed position. The width along apex 14 is 1.5 times greater than the width of midsection of upper and lower plates.

For comfortable walking, a load of about sixty percent of the walker's weight is required to achieve the solid height of the composite spring (FIG. 2B). The spring rate of the composite spring heel must be adjusted to correspond to the weight of the walker.

For each composite spring heel with a specified thickness, a range of spring heel spring rates can be obtained. The spring rate for the spring in FIG. 6 would be about fifty percent greater than the spring rate for the sprang in FIGS. 4. The greater spring rate is due to a fifty percent longer width along the apex of the spring.

The composite spring heel can have an apex width to midsection plate width ratio, that varies form 1 to 1 (FIG. 4), up to 1.5 to 1 (FIG. 6). This feature allows a manufacturer to mass produce the composite spring heels ah the same thickness, but with different widths and spring rates. This feature also allows the spring rate of the composite spring heel to change while the critical height near the front of the spring stays the same.

Figure 7:
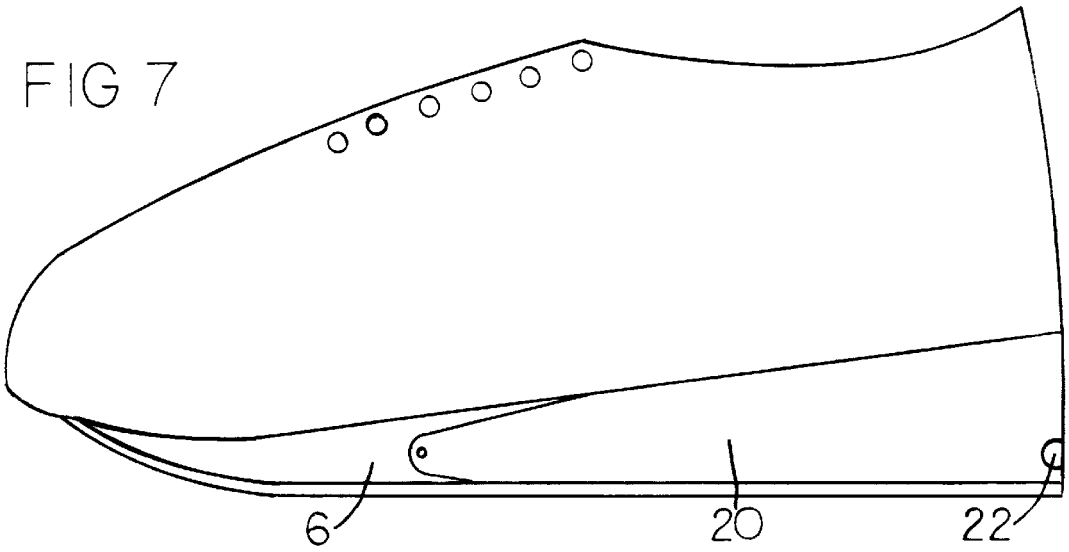
FIG. 7 is a longitudinal side view of typical walking shoe with weather resistant covering over composite spring heel.

FIG. 7 is the same as FIG. 1 except the composite spring heel is no longer visible. A weather resistant covering has been attached to outer most plate edge of upper and lower plate of composite spring heel. Vent hole 22 has been placed in covering to allow air exchange inside composite spring heel.

Figure 8:
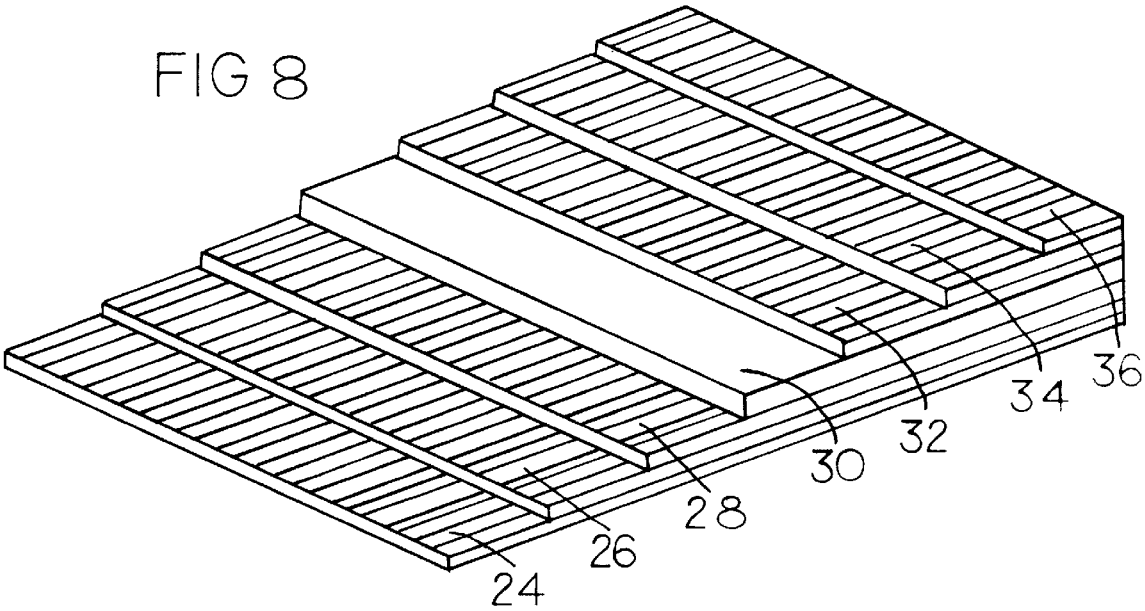
FIG. 8 is a perspective view showing lamination sequence of composite material used to construct composite spring heel.

FIG. 8 shows a sandwich lamination sequence with equal number of unidirectional layers (all fibers aligned in same direction) of composite material, on top (32, 34, 36) and bottom (24, 26, 28). Between the three top layers and three bottom layers is the center layer 30. This layer can be made out of less expensive material, such as a composite mat. The center layer can also be made out of unidirectional composite material when ultimate strength is desired.

All layers are laminated together with a suitable composite resin and stretched over V-shaped mold. After resin has cured and hardened, the V-shaped composite spring is removed from mold and cut to proper shoe size needed.

Figure 9A:
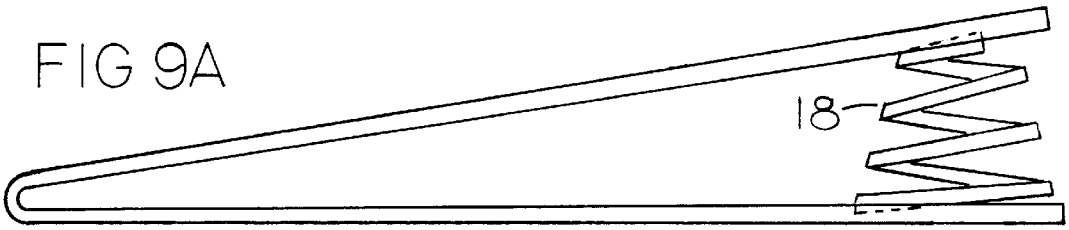
FIG. 9A shows a longitudinal side view on the composite spring heel, with optional helical compression spring in the uncompressed position.

FIG. 9A shows longitudinal side view of composite spring heel with helical compression spring 18 installed. Both spring are in fully elevated uncompressed position.

Figure 9B:
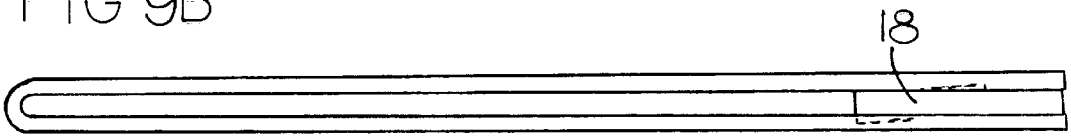
FIG. 9B shows a longitudinal side view of the composite spring heel with optional helical compression spring in fully compressed position.

FIG. 9B shows same view and object in FIG. 9A except both springs are in compressed position.

OPERATION

In this modern age, light weight composite beams are made of space age materials that give the beam a flexural strength and energy storage capability far in excess of former materials. Two such materials are fibers of glass and fibers of carbon; the carbon being the more superior. They each have a very high "Young's Modulus" and extremely high ultimate strength when used as an "outer fiber" in a beam's construction (FIG. 8).

Since the center part of the composite beam is not stressed significantly in either tension or compression, a less expensive fiber material such as "fiberglass mat" can be utilized (it will be more than capable of dealing with the "shear" forces adjacent to the beam's neutral axis). The main purpose of the "mat" is to fine tune the composite beam's thickness. The thickness of the beam determines its force handling capability and therefore, its "energy storage" capability.

The person preparing to walk in composite spring heel shoes must insure the shoes properly fit their feet. The spring rate of the shoes must also correspond to the weight of the walker. For comfortable walking a spring rate between 60 to 70 percent of the walker's weight is required to achieve full compression of the composite spring heel. For example, a 200 pound person would need spring rate between 120 to 140 pounds. When the spring rate for the properly fitted shoe is above the spring rate needed by the walker, the front laterally extended portion of the composite spring heel can be trimmed to reduce spring rate. When the spring rate must be increased, a helical compression spring is placed between the plates and attached to the bottom plate of composite spring heel.

The operation of the present invention is accomplished by first putting a pair of the composite spring heel shoes on, just like a normal pair of shoes. As one takes a step with a pair of these shoes or boots on their feet, the back heel portion of the outsole 10 will first contact the ground. The force from this contact will cause the spring heel in this shoe to begin compressing. At the beginning of the compression cycle, the composite spring heel is in the uncompressed position (FIG. 1). The composite spring heel continues to compress more as the walkers weight is transferred to the shoe's heel. As the shoe continues to pivot along the ground, the weight of the walker begins to shift from the rear of the sole to the middle of the sole. This shifting weight begins the rebound cycle for the composite spring heel. The stored energy from the compression cycle is released during the rebound cycle. FIG. 2B is the end of the compression cycle and the beginning of the rebound cycle. At the start of the rebound cycle the top plate of the composite spring heel exerts a lifting force to the shoe. As the shoe pivots to the front sole section 6 of the shoe, the composite spring heel has fully sprung back to its uncompressed position (FIG. 1).

When a higher compression and rebound force is required, the foam pad 12 can be replaced by a tapered helical compression spring 18 (FIGS. 9A, 9B).

SUMMARY, RAMIFICATIONS, AND SCOPE

Accordingly the reader will see that the composite spring heel installed in a pair of shoes or boots will allow the walker to enjoy less strenuous long distance walks. Walking is less strenuous because impact energy normally lost, is now being used to push walker forward. Each step in a shoe with a composite spring heel gives a more cushioned impact with the ground with an immediate rebound push propelling the walker forward.

The outer edges of the composite spring extend laterally beyond the sides of the sole of the shoe to produce a shoe having an adjustable spring rate. More particularly, the portion of the composite spring extending beyond the sides of the shoe may be ground down, cut, milled, ect. to reduce the overall spring rate of the compression spring. In this manner, a shoe of a specific size can be manufactured to accommodate the needs of different users requiring shoes with different spring rates.

Simply, consumer's often have different weights, and different activity levels but who share the same shoe size. The present invention provides a shoe having a spring rate which can be altered to fit the desires of the individual consumer. For example, shoes of various sizes of the present invention can be sold in the marketplace with the composite spring extending beyond the sides of the shoe. The consumer or retailer can than remove any unnecessary compression spring material from the portion extending beyond the sides of the shoe to provide a custom spring rate to fit the desires of a particular purchaser.

Having described my invention in such terms as to enable one skilled in the art to make and use it, and, having identified the best mode I presently contemplate for practicing it, I claim:

1. In a shoe, including a sole having an upper surface and a lower surface facing one another, said sole having a heel portion shaped and dimensioned to underlie the heel of the wearer's foot, a forefoot portion shaped and dimensioned to underlie the ball of the wearer's foot, and an arch portion shaped and dimensioned to underlie the wearer's foot between the heel and forefoot portion, and a spring means between said upper surface and said lower surface of said sole, the spring means, including two elongate, substantially rigid plates defining a first plate and a second plate formed integrally of the shoe's sole as a substantially V-shaped spring assembly, said V-shaped spring assembly extending at least from the arch portion of the shoe's sole to the heel portion of the shoe, the portion of said rigid plates positioned in the arch portion of the sole projecting laterally beyond said arch portion of said sole whereby selective removal of portions of said rigid plates to provide a spring means having an adjustable spring rate.

2. The shoe of claim 1 further comprising a tapered helical compression spring including a first end and a second end, said first end engaging said first plate and said second end engaging said second plate.

3. The shoe of claim 1 wherein said V-shaped spring assembly is a composite material.

* * * * *